US006276029B1

(12) United States Patent
Buettell

(10) Patent No.: US 6,276,029 B1
(45) Date of Patent: Aug. 21, 2001

(54) NECK STRAP

(75) Inventor: Bruce J. Buettell, Fullerton, CA (US)

(73) Assignee: J.A.M. Plastics, Inc., Anaheim, CA (US)

( * ) Notice: Subject to any disclaimer, the term of this patent is extended or adjusted under 35 U.S.C. 154(b) by 0 days.

(21) Appl. No.: 09/385,600

(22) Filed: Aug. 27, 1999

(51) Int. Cl.[7] ..... A44B 21/00

(52) U.S. Cl. ..... 24/30.5 P; 24/16 PB; 24/3.13

(58) Field of Search ..... 24/30.5 R, 30.5 P, 24/30.5 S, 16 PB, 17 AP, 20 R, 23 W, 20 EE, 3.1, 3.13, 3.4, DIG. 16; 206/338, 343; 248/102, 328; 224/148.6; 57/210, 258; 428/376, 364, 365

(56) References Cited

U.S. PATENT DOCUMENTS

| | | | | |
|---|---|---|---|---|
| 1,434,312 | * | 10/1922 | Penny | 24/17 AP X |
| 1,945,932 | * | 2/1934 | Caley | 24/17 AP X |
| 3,144,230 | * | 8/1964 | Brooks | 224/148.6 X |
| 4,477,950 | * | 10/1984 | Cisek et al. | 24/30.5 P |
| 4,942,644 | * | 7/1990 | Rowley | 24/16 PB |
| 5,027,477 | * | 7/1991 | Seron | 24/3.4 |
| 5,396,683 | * | 3/1995 | Ray | 24/3.13 |
| 5,398,855 | * | 3/1995 | Schaiewitz | 24/3.4 X |
| 5,407,110 | * | 4/1995 | Marsh, Jr. | 224/148.6 |
| 5,524,945 | * | 6/1996 | Georgopoulos et al. | 24/30.5 P X |
| 5,577,647 | * | 11/1996 | Pittarelli et al. | 224/148.6 |
| 5,581,850 | * | 12/1996 | Acker | 24/16 PB |
| 5,622,292 | * | 4/1997 | Dorney | 224/148.6 |
| 5,667,114 | * | 9/1997 | Bourque | 224/270 |
| 5,970,585 | * | 10/1999 | Scholey | 24/16 PB X |
| 6,036,066 | * | 3/2000 | Giacona, III | 224/148.6 |
| 6,131,780 | * | 10/2000 | Becker | 224/148.6 |

* cited by examiner

*Primary Examiner*—Robert J. Sandy
(74) *Attorney, Agent, or Firm*—Knobbe, Martens, Olson & Bear, LLP

(57) ABSTRACT

A plurality of neck straps are cut from a sheet of vinyl, with each strap having locking ends formed integral with the main body of the strap. The strap has a thin, flat configuration with vinyl surfaces which provide a cloth-like feel.

18 Claims, 3 Drawing Sheets

NECK STRAP

BACKGROUND OF THE INVENTION

1. Field of the Invention

The present invention relates to neck straps or lanyards that fit around a person's neck and are typically used to support a name tag, a key, or other such item, including purely decorative items.

2. Description of the Related Art

Neck lanyards are made from a variety of materials, including metal chains, smooth vinyl, and woven materials, such as a cotton cord. Such cords have become increasingly popular because they are considered by some to be more attractive than metal or vinyl lanyards and because of the soft feel provided by the material.

Prior art lanyards generally include an attachment mechanism at the ends so that the ends can be joined after the lanyard has been positioned around a person's neck. That enables the wearer to put the lanyard in place or remove it without having to lift a closed loop over the wearer's head. As a safety measure, the locking mechanism is usually a breakaway type that will separate or break away in response to the application of a separating force of a predetermined level. Examples of breakaway mechanisms are Velcro strips, plastic tubes, metal snaps, and plastic joints. The locking mechanism is usually composed of two elements which are separate from the remainder of the lanyard, and thus must be assembled or attached to the lanyard during the production process. This, of course, adds to the cost of the item. While neck lanyards are generally inexpensive items, they are frequently made in such large volume that each increment of cost savings can be significant.

Vinyl and woven lanyards are sometimes printed with text or other graphics. The printing is usually part of a marketing promotion or a way to identify a particular business that is distributing the lanyards to its employees or to identify attendees at a convention. Woven shoestring-like lanyards, having a flat profile, are usually imprinted by securing the cord to a member that guides the cord under a printing head. The printing is thus a separate step performed after the individual lanyard has been formed. The printing is generally on a single strand at a time, and hence is relatively expensive because of the requirement for careful guiding of the lanyard into the printing head, and the synchronization between the printing head and the guiding member.

Advantageously, vinyl lanyards can be imprinted as a group before individual lanyards are cut from a vinyl sheet. However, the most common type of smooth vinyl is transparent, and thus does not lend itself to printing very well. Some success has been had with printing on white or black vinyl.

Notwithstanding the many different types of neck straps and lanyards currently available, it is believed that there is a need for an improved lanyard that is simple to produce, has the necessary breakaway locking elements, and has a desired feel and attractive appearance.

SUMMARY OF THE INVENTION

In accordance with one aspect of the present invention, a neck lanyard is provided that has a thin, flat configuration with a generally rectangular cross-section. The lanyard is made of plastic such as polyvinyl chloride resin and has two flat exterior surfaces with a vinyl foam skin which provide the strap with a cloth-like feel and appearance, somewhat comparable to woven cords. The vinyl material is available in many colors and readily lends itself to having printing formed thereon. Since a quantity of lanyards can be cut at one time from a vinyl sheet, it is very practical to provide the printing on the material while it is in sheet form.

In another aspect of the invention, a neck lanyard is provided with male and female connecting portions that are formed integral with the strap itself. This significantly saves in the cost of production. Further, the ends can be readily connected by the user, and will advantageously break away with a predetermined separating force, that is considerably less than the force required to rupture the body of the lanyard. Preferably, the lanyard is made of vinyl having the cloth-like surface referred to above.

In accordance with another aspect of the invention, a neck lanyard is provided having generally flat ends that are releasably connected. One end has intersecting slits, such as a T-shaped slit, while the opposite end has a head on its outer tip joined to an adjacent narrower neck. The head will fit edgewise into the vertical slit of the T-shape, and the ends may then be twisted 90° with respect to each other so that the neck fits within the horizontal slit of the T-shape. The width of the head is greater than the width of the horizontal slit so that the head is captured by the slit. The interconnecting ends are formed of a flexible plastic material, such that the head and the slit will deform when subjected to a predetermined separating force so that the head can be pulled from the slit. This, however, does not tear the material, so that the lanyard ends can be once more reconnected, if desired. Preferably, these lanyards ends are formed integral with the lanyard itself and are preferably made of the vinyl material referred to above.

In accordance with another aspect of the invention, a group of thin, flat, narrow lanyards can be cut at one time from a vinyl sheet, with the lanyards positioned in side-by-side relation on the sheet. The individual lanyard has a female locking portion on one end which is wider than a male locking portion on the opposite end. To maximize the number of lanyards that can be cut from a vinyl sheet, adjacent lanyards are inverted from end-to-end with respect to each other. That is, the female end of one lanyard is adjacent the male end of an adjacent lanyard. Further, adjacent lanyards are longitudinally offset with respect to each other so that the main body portions of the lanyards can be closely positioned, with the wider female portions being longitudinally offset with respect to the narrower male portions. Such an arrangement advantageously allows close positioning of the lanyards and maximizes the number of lanyards made from a vinyl sheet. Further, the lanyards may be imprinted while still in sheet form, to minimize the expense of the printing operation.

DETAILED DESCRIPTION OF THE PREFERRED EMBODIMENT

Figure 1:
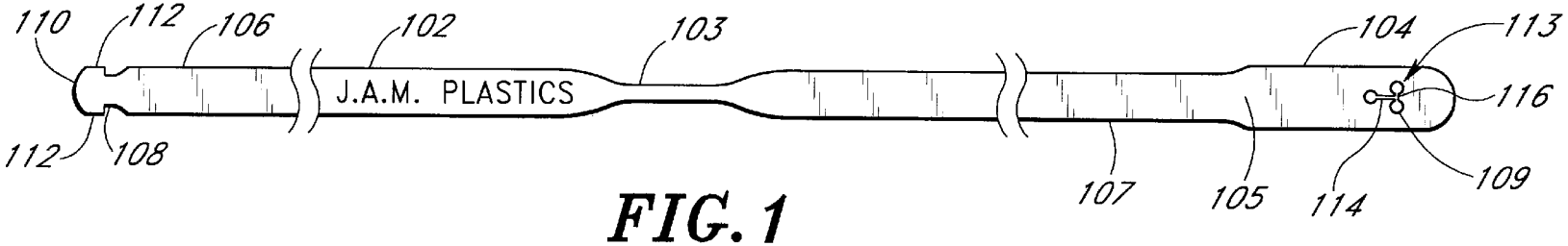
FIG. 1 illustrates a vinyl lanyard in accordance with the present invention.

Referring to FIG. 1, there is illustrated a neck lanyard or strap formed by an elongated flexible member or body 102 having a thin, flat configuration. As may be visualized from FIGS. 2 and 5, the member has a generally rectangular cross-section having two opposing flat exterior surfaces 105 joined by shorter edges 107.

In accordance with the invention, the lanyard has releasable connections on opposite ends that are formed integral with the remainder of the strap. That is, the lanyard, together with its ends, is formed as a single piece, cut from a sheet of vinyl. A first or male end 106 of the lanyard includes a head 110 connected to an adjacent narrower neck 108. The opposite end 104 includes an opening or slit 113 configured to receive and capture the head. The head includes a pair of ears or lateral projections 112 that extend beyond the width of the neck 108. In a preferred form of the lanyard, the main body 102 is about ⅜ inch in width except for a narrow midsection 103 which is about 5/32 of an inch. The midsection is narrowed to facilitate the attachment of a name badge or other item to be carried on the strap. The width of the head 110 is also about ⅜ inch. The neck has a width of about 7/32 of an inch, thus creating about 5/32 differential, with respect to the head. Consequently, each ear or projection on each side of the head extends beyond the neck about 5/64 of an inch. The dimension between the tip of the head and the neck is about ¼ inch. Naturally, these dimensions can be scaled up or down consistent with the overall size of the elements; however, these dimensions have proven to be quite functionally satisfactory.

While various slits or openings may be formed the opposite or female end 104 of the lanyard to receive the male end, the opening 113 preferably is formed by intersecting slits, such as a generally T-shape formed by a vertical slit 114 of the T, extending generally parallel to the longitudinal axis of the strap, and a horizontal slit 116 intersecting the slit 114 and extending transversely across the strap with respect to the longitudinal axis. To prevent extension of the slits and to facilitate insertion of the head 110 into the slit 113, the three outer ends of the T-shaped slit 113 are formed with small circles 109.

In a preferred form of the lanyard, the width of the strap end 104 is about ½ inch. The vertical portion 114 of the T-shaped slit is preferably about 5/16 of an inch to the outer edge of a circle 109. The horizontal portion 116 of the slit is about 7/32 to the outer edges of the circles 109. The circles 109 have a diameter of about 1/16 of an inch.

Figure 2:
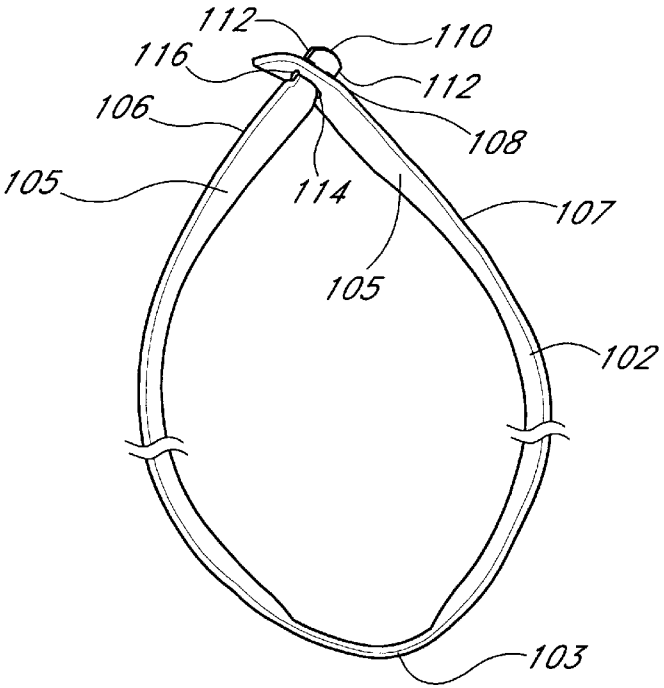
FIG. 2 illustrates the lanyard of FIG. 1, with one end of the lanyard inserted into a slit in the otter end.
Figure 5:
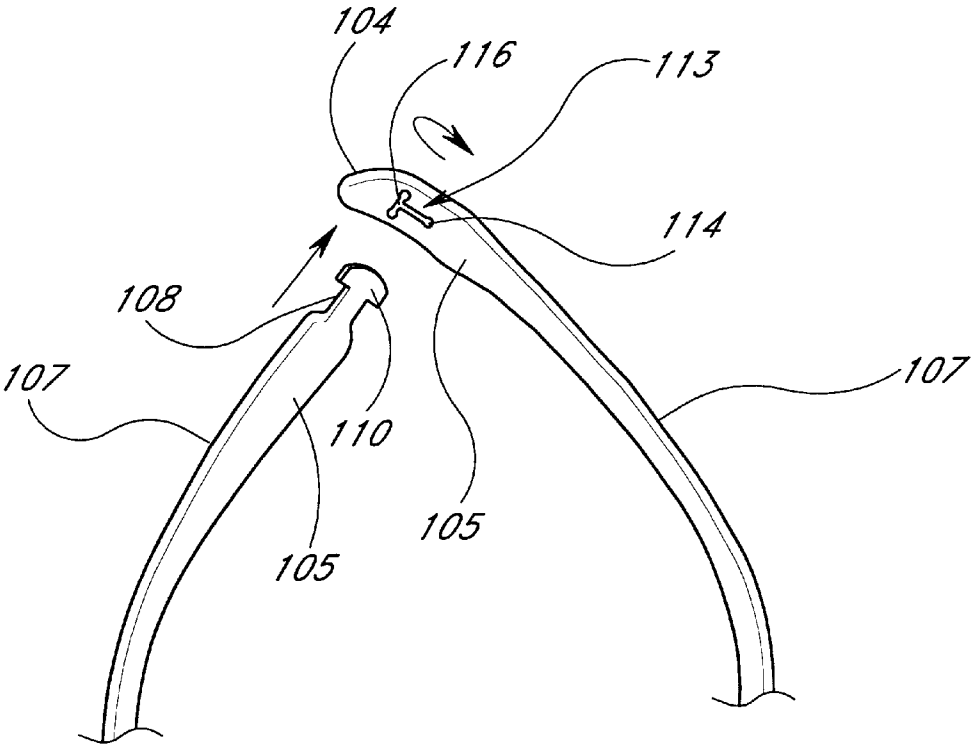
FIG. 5 is an enlarged perspective view illustrating the ends of the lanyard of FIG. 1 about to be connected.
Figure 4:
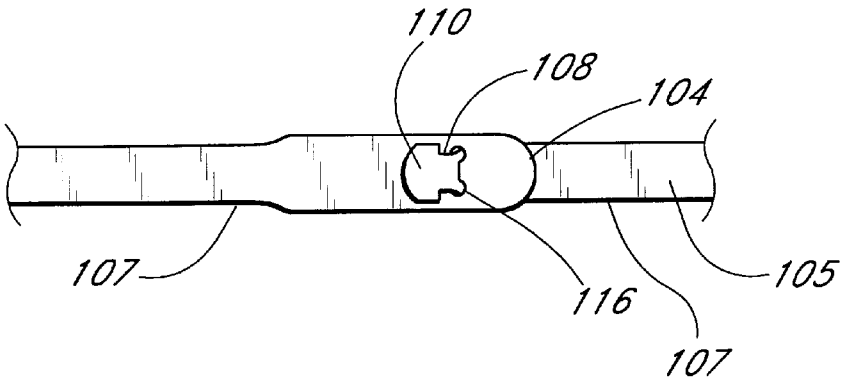
FIG. 4 is a plan view of the ends of the lanyard connected and in overlying relation.

In connecting the lanyard ends, the male end 110 can be turned about 90° and inserted edgewise into the vertical slit 114, as illustrated in FIG. 5 and FIG. 2. Since the dimension between the neck 108 and the tip of the head 110—in other words, the height of the head 110—is about 4/16 and the length of the vertical portion 114 of the slit is about 5/16 of an inch. The head may be readily inserted edgewise through the slit 114. After that, the ends are rotated back about 90° with respect to each other so that the ends 104 and 105 lie generally parallel to each other in overlapping relation, as illustrated in FIG. 4. In this position, the neck 108 fits within the horizontal slit 116 of the T-shaped slit 113, and the ears 112 of the head 110 extend beyond the horizontal slit portion 116. Consequently, the ears on the head capture the head within the slit.

It is desirable that the strap ends will separate or break away under a predetermined separating force. At that level, the force on the ears 12 distorts the shape of the head 110 into somewhat of a semicircular shape that allows the head 110 to be pulled through the T-shaped slit, thus unlocking the lanyard. As may be appreciated, the dimensions of the ears 112 on the head 110 can be set to adjust the level of force which unlocks the lanyard. Further, the dimensions of the slit 116 can be varied to adjust the desired level of force for a breakaway condition. The adjustment in the dimensions of the ears on the head 106 and of the slit in the female end allows for accurate and reliable setting of the level of force that is applied to the lanyard to unlock it. This provides a measure of safety to prevent injury to the wearer if, for example, a person should grab the looped lanyard and pull beyond the predetermined level.

The lanyard may be made of a variety of flexible plastic materials, having a fabric or cloth appearance and feel. It is preferably formed of a polyvinyl chloride material that is strong but has an exterior surface on both sides that provides the softness and comfort of fabric. Vinyl sheets of this type are commercially available formed smooth on one side and soft fabric-like on the opposite side. By placing the smooth sides of two sheets in back-to-back relation and joining them by suitable known techniques, the cloth-like surface is made available on both of the larger flat surfaces 103 of the lanyard. In accordance with one technique, a die is applied to the stacked sheets around the periphery of the lanyards to be formed, and RF energy is applied to the die. This energy causes the sheets to seal together where the RF energy is applied. Such technique is sometimes referred to as RF sealing. The individual sheet material of this type may be purchased from various sources, one being Gane Brothers of Elk Grove Village, Ill., which has a distributor in Commerce, Calif., with the product being referred to as Vel-Touch.

It is understood that the sheet material has a base layer of polyvinyl chloride resin which is compounded with various additives to form a vinyl plastisol. That composite is cast into a layer or film that is flexible but strong and not very stretchy. To that layer is laminated a skin of "foam" or expanded vinyl that provides the appearance and feel of fabric. That skin is soft and flexible and not so strong relative to the base layer.

Other plastic materials for the lanyards can be used since they have some desirable characteristics but are not as desirable as the vinyl base material with a layer of foam vinyl. For example, a lanyard with a solid vinyl base and a flocked vinyl surface is strong and has a cloth-like appearance, but it does not have the same feel as the vinyl foam.

Another material has a foam vinyl base layer coated with a strong outer skin made to look like leather. That material is attractive and has some softness due to the foam. However, the outer skin cannot "breathe" like foam skin of the preferred material.

Figure 3:
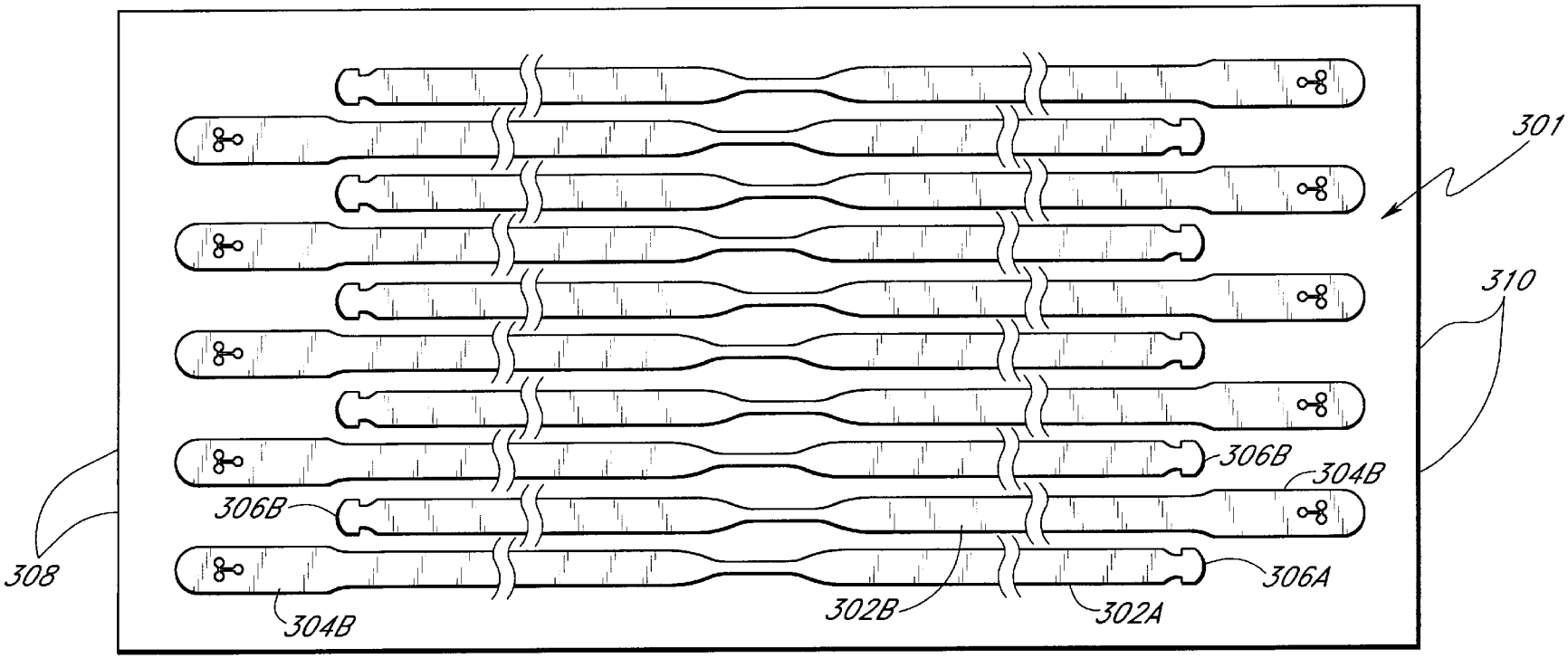
FIG. 3 illustrates a vinyl sheet marked with a cutting pattern for a series of lanyards, so as to efficiently utilize the sheet.

FIG. 3 illustrates a vinyl sheet 301 that is marked with a cut-away pattern for a die to form a set of vinyl lanyards in accordance with the present invention. The vinyl sheet 301 of the desired vinyl material is preferably printed with desired graphics before the lanyard patterns are cut from the sheet. The cutting die pattern provides that the lanyards be laid out in an alternating and staggered manner. The lanyard pattern 302A has its male end 306A adjacent an edge 310 of the sheet 301, and has its female end 304A adjacent an opposite edge 308 of the sheet 301. A second lanyard pattern 302B, adjacent to the first lanyard pattern 302A, has its female end 304B adjacent the edge 310 of the sheet 301 such that the female end 304B is adjacent to male end 306A of the adjacent lanyard. Similarly, the male end 306B near the edge 308 of the sheet 301 is adjacent to the female end 304A of the adjacent lanyard pattern 302A. Thus, the lanyard patterns are in an inverted, end-for-end relation with adjacent patterns.

The lanyard patterns are also staggered or offset longitudinally so as to conserve vertical space by the vinyl sheet 301. The pattern 302A is positioned at a first horizontal displacement from the edge 308 of the sheet. The second pattern 302B, adjacent to the pattern 302A, is positioned at a second horizontal displacement from the edge 308. The female portion 304A of the first pattern 302A is closer to the sheet edge 308 than the male portion 306B of the second pattern 302B. Thus, the lanyard patterns can be positioned close together in a side-by-side relation. The space between lanyards is minimized because the body of the lanyard patterns is narrower than the female end. The female ends takes up less side-by-side space when they are not positioned completely side-by-side with respect to the male end of an adjacent lanyard pattern. With the arrangement and the lanyard dimensions mentioned above, only about ⅛ space between adjacent lanyard bodies 102 as needed.

The above description is given by way of example and not limitation. Given this disclosure, one skilled in the art could devise variations that are within the scope and spirit of the invention. Further, the various features of this invention can be used alone or in varying combinations with each other, and are not intended to be limited to the specific combination described herein. Thus, the invention is not to be limited by the illustrated embodiment, but is to be defined by the following claims, when read in the broadest manner to preserve the validity of the claims.

What is claimed is:

1. A neck lanyard, comprising an elongated, flexible member having a thin, flat configuration with a generally rectangular cross-section, having two opposing flat exterior surfaces joined by two shorter edges, said member, including said flat exterior surfaces, comprising non-woven, non-braided plastic with said flat exterior surfaces having a cloth-like feel and appearance.

2. The lanyard of claim 1, wherein said member has ends that are made of the same material as the remainder of the member and are formed as one piece with the remainder of said member and have said thin, flat configuration, said ends connect to form a loop, the ends being configured so that they can be separated by pulling the ends apart.

3. The lanyard of claim 2, wherein one of said ends has a flat head and neck configuration and the opposite end has an opening configured to receive and releasably capture said head with the neck positioned in the opening.

4. The lanyard of claim 3, wherein said opening is in the form of a slit configured to enable said head to be inserted edgewise into the slit and then manipulated so that the head is captured therein.

5. A neck lanyard, comprising an elongated flexible member having a thin, flat configuration with a generally rectangular cross-section having two opposing flat exterior surfaces joined by two shorter edges, said member comprising plastic with said flat exterior surfaces having a cloth-like feel and appearance, said member having ends that connect to form a loop, the ends being configured so that they can be separated by pulling the ends apart, one of said ends including a generally T-shaped slit, and the opposite end has a head adapted to fit edgewise into the vertical portion of the T-shaped slit and then rotated about 90 degrees so that the neck adjacent said head fits within the horizontal portion of the T-shaped slit with exterior portions of the head resisting withdrawal of the head from the slit.

6. A neck lanyard, comprising an elongated, flexible member having a thin, flat configuration with a generally rectangular cross-section having two opposing flat exterior surfaces joined by two shorter edges, said member comprising plastic with said flat exterior surfaces having a cloth-like feel and appearance, wherein said member comprises polyvinyl chloride resin having a base layer of strong, relatively non-stretch material with an exterior foam-like skin.

7. A neck lanyard, comprising an elongated flexible member having ends adapted to releasably connect to form the member into a loop, one end of said member having a T-shaped slit, with the other end of the member having a head and a neck adapted to fit within the T-shaped slit, the head and the neck configured to be inserted edgewise into the vertical portion of the T-shaped slit and to be twisted about 90 degrees so that the neck adjacent said head fits within the horizontal portion of the T-shaped slit while the other edges of the head extend beyond the ends of the horizontal portion of the slit so as to resist withdrawal of the head from the slit, said ends being deformable to allow the lanyard ends to be separated by withdrawing the head from the slit, said member having a substantially uniform width between said side edges and between said ends except for a midsection which is narrowed to facilitate the attachment and the positioning of a name badge or other item to be carried on the lanyard.

8. The lanyard of claim 7, wherein said ends are formed as one piece with said elongated member.

9. The lanyard of claim 7, wherein said member comprises polyvinyl chloride resin.

10. A neck lanyard, comprising an elongated flexible member having ends adapted to releasably connect to form the member into a loop, one end of said member having a T-shaped slit, with the other end of the member having a head and a neck adapted to fit within the T-shaped slit, the head and the neck configured to be inserted edgewise into the vertical portion of the T-shaped slit and to be twisted about 90 degrees so that the neck adjacent said head fits within the horizontal portion of the T-shaped slit while the other edges of the head extend beyond the ends of the horizontal portion of the slit so as to resist withdrawal of the head from the slit, said ends being deformable to allow the lanyard ends to be separated by withdrawing the head from the slit, said ends being formed as one piece with said elongated member, said member having two exterior surfaces formed of vinyl foam that provides a cloth-like feel and appearance.

11. A neck lanyard, comprising an elongated flexible member having a thin, flat configuration with a generally rectangular cross-section, said member having male and female ends which are formed as one piece with said member, said ends being configured to be connected to each other to form the member into a loop, and the ends being adapted to be separated by pulling the ends apart, said member having two exterior surfaces formed of vinyl foam that provides a cloth-like feel and appearance.

12. The lanyard of claim 11, wherein said member comprises flexible plastic having characteristics that permit said ends to be deformed so as to be pulled apart.

13. The lanyard of claim 11, wherein said female end includes an opening configured to receive and capture a head on said male end.

14. A neck lanyard, comprising an elongated, flexible member having a thin, flat configuration with a generally rectangular cross-section, having two opposing flat exterior surfaces joined by two shorter edges, said member including said flat exterior surfaces, comprising plastic with said flat exterior surfaces having a cloth-like feel and appearance, said member having an inner layer that is flexible but strong and not very stretchy, and has exterior layers forming said exterior surfaces that are soft and flexible and not as strong as the inner layer.

15. A neck lanyard, comprising an elongated, flexible member having a thin, flat configuration with a generally rectangular cross-section, having two opposing flat exterior surfaces joined by two shorter edges, said member including said flat exterior surfaces, comprising plastic with said flat exterior surfaces having a cloth-like feel and appearance, said member having a solid vinyl base layer with said flat exterior surfaces being formed as flocked vinyl.

16. A neck lanyard, comprising an elongated, flexible member that has an interior plastic portion that is strong but not very stretchy, and has exterior surfaces formed of plastic foam that is soft and flexible and not as strong as the interior portion.

17. A neck lanyard, comprising an elongated, flexible member that is made of non-woven, non-braided plastic with exterior surfaces having a cloth-like feel and appearance.

18. The lanyard of claim 17, wherein said exterior surfaces are made of vinyl foam.

* * * * *